US008226087B2

(12) United States Patent
Brustmeyer

(10) Patent No.: US 8,226,087 B2
(45) Date of Patent: Jul. 24, 2012

(54) CARD-GUIDED PROJECTILE AND TARGET GAME

(76) Inventor: Maxwell Brustmeyer, East Northport, NY (US)

( * ) Notice: Subject to any disclaimer, the term of this patent is extended or adjusted under 35 U.S.C. 154(b) by 286 days.

(21) Appl. No.: 12/635,032

(22) Filed: Dec. 10, 2009

(65) Prior Publication Data

US 2010/0148434 A1 Jun. 17, 2010

Related U.S. Application Data

(60) Provisional application No. 61/201,488, filed on Dec. 11, 2008.

(51) Int. Cl.
*A63F 7/00* (2006.01)

(52) U.S. Cl. ..... 273/342; 273/298; 273/398; 273/400

(58) Field of Classification Search ..... 273/342, 273/400–402, 496, 292, 298, 398
See application file for complete search history.

(56) References Cited

U.S. PATENT DOCUMENTS

| | | | | |
|---|---|---|---|---|
| 4,793,619 | A * | 12/1988 | Unander-Scharin | 473/569 |
| 5,112,061 | A | 5/1992 | Lamle | |
| 5,163,688 | A * | 11/1992 | Simms | 273/298 |
| 5,690,333 | A * | 11/1997 | Danner et al. | 273/260 |
| 6,276,686 | B1 | 8/2001 | Chille | |
| 6,474,648 | B1 * | 11/2002 | Rogers | 273/298 |
| 6,783,128 | B2 | 8/2004 | Casey et al. | |
| 7,118,107 | B2 | 10/2006 | Niedner et al. | |
| 7,207,565 | B1 | 4/2007 | Masty, III | |
| 7,325,807 | B1 | 2/2008 | Eason | |
| 7,374,171 | B1 | 5/2008 | Mencarelli | |
| 7,516,960 | B1 * | 4/2009 | Battiste | 273/342 |
| 7,909,328 | B2 * | 3/2011 | Otter | 273/298 |
| 7,955,195 | B2 * | 6/2011 | Payer | 473/410 |
| 2004/0188942 | A1 * | 9/2004 | Trokan | 273/342 |
| 2005/0116413 | A1 * | 6/2005 | Wagner | 273/242 |
| 2006/0012123 | A1 * | 1/2006 | Cavanaugh et al. | 273/292 |
| 2006/0226606 | A1 * | 10/2006 | Finley et al. | 273/342 |
| 2007/0107460 | A1 * | 5/2007 | Webb et al. | 62/457.3 |
| 2007/0200293 | A1 * | 8/2007 | Gomez et al. | 273/242 |
| 2010/0148434 | A1 * | 6/2010 | Brustmeyer | 273/108 |
| 2010/0244384 | A1 * | 9/2010 | Hoffer | 273/342 |
| 2011/0204570 | A1 * | 8/2011 | Lombardi | 273/348 |

FOREIGN PATENT DOCUMENTS

| | | | |
|---|---|---|---|
| GB | 2392109 A | * | 2/2004 |
| GB | 2455115 A | * | 6/2009 |

* cited by examiner

*Primary Examiner* — Raleigh W. Chiu
(74) *Attorney, Agent, or Firm* — Dilworth & Barrese, LLP

(57) ABSTRACT

A card-guided projectile and target game includes a game surface having first and second opposite ends. The game surface extends between the ends. The game surface includes indicia for delineating regions of the surface. At least one projectile, at least one projectile receiver, and at least one playing card includes indicia for in-game card guided play of a beverage drinking game.

8 Claims, 2 Drawing Sheets

1526-2

CARD-GUIDED PROJECTILE AND TARGET GAME

CROSS REFERENCE TO RELATED APPLICATIONS

The present application claims the benefit of U.S. provisional application No. 61/201,488, filed Dec. 11, 2008, the entire contents of which being hereby incorporated by reference herein.

TECHNICAL FIELD

The present disclosure generally relates to board games, video games and games utilizing projectiles and targets, and more particularly, to a card-guided projectile and target game, which can be employed with a beverage drinking game.

BACKGROUND OF THE INVENTION

The indulgence and participation in games has existed for centuries. Individuals have engaged in a variety of games over the centuries to stimulate competition, camaraderie and enjoyment. Many styles and types of games exist. In a recent popularized game, Beer Pong, also know as "Beirut", is a beverage drinking game in which players throw a ping pong ball across a table with the intent of landing the ball in one of several cups of a beverage, such as, for example, beer on the other end.

Beer Pong typically includes two, two-player teams, one on each side of a table, and a number of cups set up on each side. Rules may vary widely. In one example, a Beer Pong game can have six or ten plastic cups arranged in a triangle on each side. The number of players on a team can vary as well, from one to three or more. When a ball lands in a cup, as a consequence, the opposing team consumes the beer in that cup. In this particular example of a Beer Pong game, the game is won by eliminating the other team's cups before all of one's own cups are eliminated. The losing team consumes the beer remaining in the winning team's cups.

The popularity of Beer Pong has increased over the years, as reflected in the article displayed from www.associatedcontent.com. The game of Beer Pong has had particular popularity at colleges in the United States. A national organization exists for the Beer Pong game, for example, see the website www.nbpl.net.

Therefore, it would be desirable to provide a card-guided projectile and target game, which can be employed with a beverage drinking game, as well as related methods of use. The present disclosure describes an improvement over the prior art games and technology.

SUMMARY OF THE INVENTION

Accordingly, a card-guided projectile and target game is provided, which can be employed with a beverage drinking game, as well as related methods of use. In one embodiment, the game includes cards with in-game direction for playing the game. It is envisioned that the game is easily and efficiently manufactured and assembled.

In one embodiment, a card-guided projectile and target game is provided in accordance with the principles of the present disclosure. The card-guided projectile and target game includes a game surface having first and second opposite ends. The game surface extends lengthwise therebetween. The game surface includes indicia for delineating regions of the surface. The card-guided projectile and target game includes at least one projectile and at least one projectile receiver. The card-guided projectile and target game also includes at least one playing card having indicia for in-game card guided play of a beverage drinking game.

In one embodiment, a kit for playing a card-guided projectile and target game is provided. The kit includes at least one deck of playing cards. Each playing card includes indicia for in-game card guided play of a beverage drinking game. The indicia of the at least one playing card includes instructions for manipulating the projectile and the projectile receiver.

In one embodiment, a method for playing a card-guided projectile and target game is provided. The method includes the steps of: providing a game surface, at least one projectile, at least one projectile receiver, and at least one playing card including indicia for in-game card guided play of a beverage drinking game; selecting a playing card; and engaging in game play according to the indicia for in-game card guided play of the beverage drinking game.

BRIEF DESCRIPTION OF THE DRAWINGS

The above and other objects, features and advantages will become more readily apparent from the specific description accompanied by the following drawings, in which.

Like references indicate similar parts throughout the figures.

DETAILED DESCRIPTION OF THE INVENTION

Figure 1:
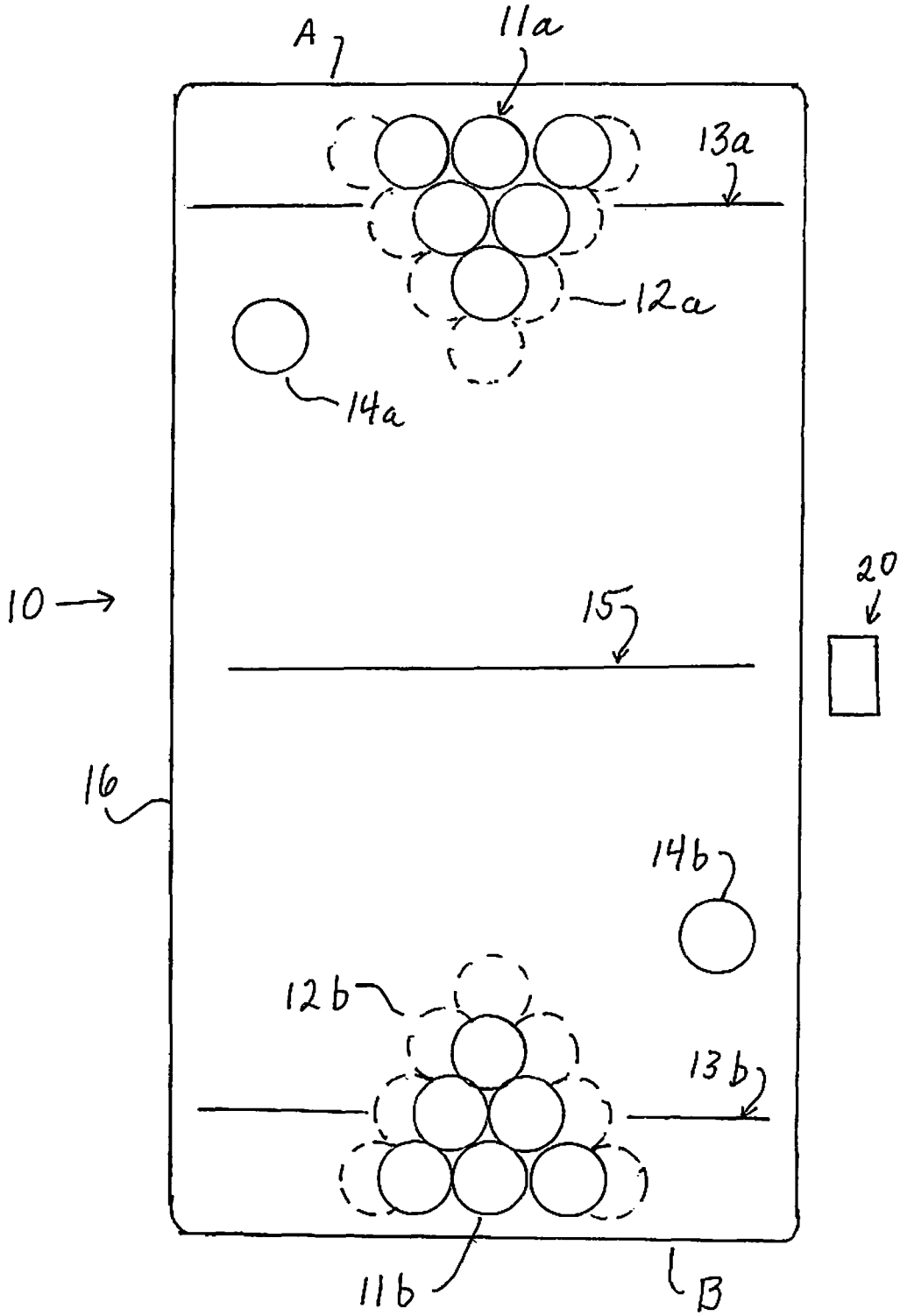
FIG. 1 is a plan view of a game surface for a card-guided projectile and target game.

The exemplary embodiments of the card-guided projectile and target game and methods of use disclosed are discussed in terms of a card game for employment with a beverage drinking game, such as, for example, a beer pong game. Alternatively, it is envisioned that the present disclosure may be employed with other types of games such as, for example, games of skill, non-drinking games, and video games including those employing television monitors and/or hand held video devices. It is further envisioned that the beverages include soda, juice, water, beer and liquor. It is contemplated that the present disclosure can be used with any liquid.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

The following discussion includes a description of the card-guided projectile and target game, related components and exemplary methods of employing the game in accordance with the principles of the present disclosure. Alternate embodiments are also disclosed. Reference will now be made in detail to the exemplary embodiments of the present disclosure, which are illustrated in the accompanying figures. Turning now to FIGS. 1-4, there is illustrated a card-guided projectile and target game for employment with a beverage drinking game, such as, for example, a beer pong game in accordance with the principles of the present disclosure.

The card-guided projectile and target game includes playing cards, which are fabricated from materials suitable for card play and amusement and/or a beverage drinking game, such as paper and/or plastic materials, other polymers and metals may also be used, depending on the particular application and/or preference. Such playing cards may also include an outer protective coating and/or lamination. One skilled in the art, however, will realize that other materials and fabrication methods suitable for assembly and manufacture, in accordance with the present disclosure, also would be appropriate.

In one particular embodiment, the card-guided projectile and target game is employed with a beer game apparatus. Exemplary beer pong rules are employed, such as those employed in standard play for the beer pong game apparatus, as shown in FIG. 1. It is contemplated that various versions of beer pong rules may be employed such as, for example, those described at the following websites, http://www.bpong.com/vault/general-beer-pong-rules, http://www.bpong.com/wsobp/official-rules-of-the-worl-series-of-beer-pong#1, http://en.wikipedia.org/wiki/Beer_Pong and/or http://www.beerpong.com/beerpong_rules.htp.

FIG. 1 illustrates a beer pong set-up on a game surface, such as, for example, a game board 10. In one embodiment, a standard game board can be provided on a foldable or rollable sheet of flexible plastic film of predetermined length and width having indicia as described herein for indicating placement of a border line, receptacles, foul lines and bounce line. The game board can be set up on one or more tables to provide a standard playing field. The game board and/or indicia representing the elements of a beer pong game may be formed with a table or other similar structure, such as by imprinted indicia, molding or other fabrication methods. It is envisioned that board 10 may also be formed of paper, metal or other materials.

At end A of game board 10, where one beer pong player or team of players is positioned, an arrangement of six cups 11*a* partially filled with beer or some other beverage is positioned in the vicinity of a foul line 13*a*. Alternatively, a ten cup arrangement 12*a* can be used. A wash cup 14*a* containing water can be used to wash the ping pong balls after shooting. During the beer pong game, a player shoots a projectile, such as, for example, a ping pong ball into a projectile receiver, such as, for example, a cup. It is envisioned that the projectile may also include other types of ball/objects such as rubber, plastic, and may include dice and caps. It is further envisioned that the projectile receiver may include a bowl or other type of drinking receptacle.

At end B of game board 10, where the opposing player or team of players is positioned, a similar rack of six cups 11*b* or ten cups 12*b* of beverage is arranged at an opposing foul line 13*b*. Another wash cup 14*b* is available.

Bounce line 15 extends laterally across table midway between ends A and B and delineates the line past which bounced projectiles land for a shot to be considered valid. Perimeter line 16 indicates a border defining a periphery of game board 10 for valid game play.

The card guided projectile and target game includes playing cards, examples of which being described below, which are provided for playing the card guided projectile and target game with beer pong game board 10 for a beer pong game. A deck 20 including 56 playing cards (including instruction card) is shuffled and placed face down at the edge of beer pong game board 10 at about midway between ends A and B. Before each shot, the shooting player selects a playing card of the card guided projectile and target game, turns it over and displays it to the other players. The shooting player then follows the directions and/or guidance displayed as indicia on the playing card. The indicia displayed from the playing card can include direction and/or guidance for performance and/or non-performance of various activity including shot types, shot form and personal team or group action or other conduct during game play. Deck 20 may include one or a plurality of playing cards, and may include decks of less than 56 cards and/or more than 56 cards.

Figure 2:
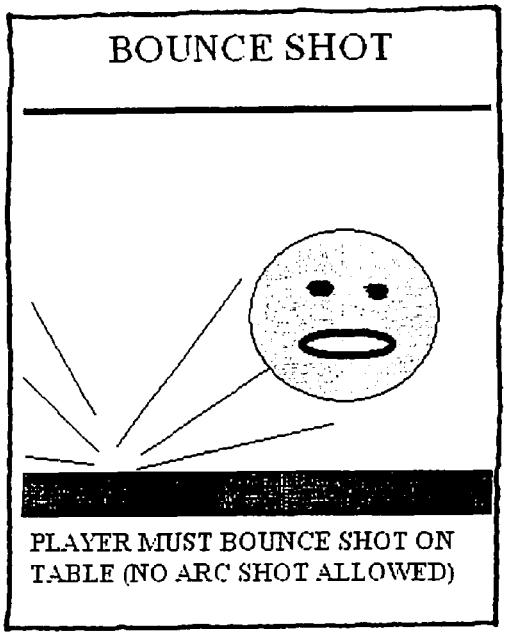
FIG. 2 is a plan view of one particular embodiment of a playing card for a game in accordance with the principles of the present disclosure.

During game play, for example, a shooting player, which may be a member of a team or group, executes a turn of the game by selecting from the top of deck 20 a playing card, such as, for example, a BOUNCE SHOT playing card, as shown in FIG. 2. The BOUNCE SHOT playing card displays indicia to the shooting player, which includes the direction/guidance: PLAYER MUST BOUNCE SHOT ON TABLE (NO ARC SHOT ALLOWED). As such, the shooting player will execute the turn or indicated shot as described on the BOUNCE SHOT playing card, as provided by the pictorial and graphic material of the BOUNCE SHOT playing card in connection with the above described textual instruction displayed from the playing card. The pictorial and graphic material of the BOUNCE SHOT playing card includes a facial representation with a ping pong ball and engagement with a table surface. It is envisioned that the BOUNCE SHOT includes bouncing the ball on the table before going into any cup. Any number of bounces is allowed. It is envisioned that the ball must bounce on the table and not be an arc shot. It is envisioned that if the ball goes in the cup without bouncing on the table first, it does not count.

Execution of the indicated shot displayed from the BOUNCE SHOT playing card is conducted in association with the beer pong rules selected for game play. For example, if the shooting player successfully executes the indicated shot, the cup is removed from the playing surface and a player of the opposing team drinks the contents of the cup. If the shooting player fails to successfully execute the indicated shot, the shot is considered a miss. No cups are removed from the playing surface. The next player, which may be of the same team or an opposing team, will select a card for that player's turn. It is envisioned that the beer pong rules employed can include house rules, standard official rules, Beirut rules and/or other variations.

During game play, if the shooting player successfully executes the indicated shot, the shooting player or an alternate member of the successful shooting player's team or group selects another playing card from the card guided projectile and target game playing card deck 20. If the shooting player fails to execute the indicated shot, an opposing shooting player, which may be a member of an opposing team or group playing the game, selects a playing card.

Figure 3:
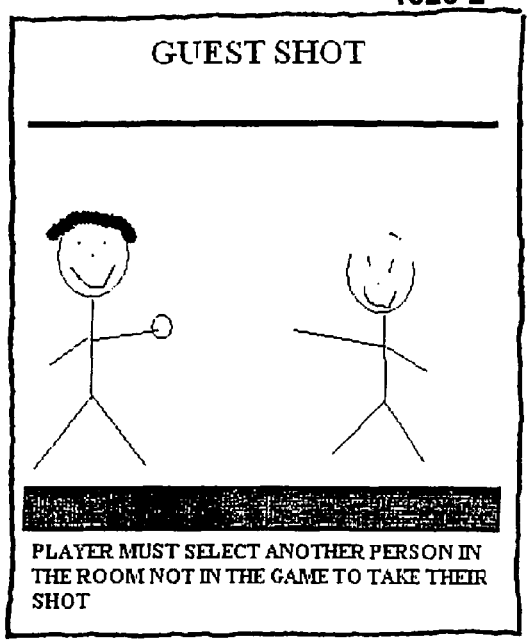
FIG. 3 is a plan view of one embodiment of a playing card for the game.

In one embodiment, the shooting player, may select a playing card, such as, for example, a GUEST SHOT playing card, as shown in FIG. 3. The GUEST SHOT playing card displays indicia to the shooting player, which includes the direction/guidance: PLAYER MUST SELECT ANOTHER PERSON IN THE ROOM NOT IN THE GAME TO TAKE THEIR SHOT. As such, the shooting player will execute the turn or indicated shot as described on the GUEST SHOT playing card, as provided by the pictorial and graphic material of the GUEST SHOT playing card in connection with the above described textual instruction displayed from the playing card. The pictorial and graphic material of the GUEST SHOT playing card includes a representation of two persons, one of which being a guest in the room. It is contemplated that if no guests are in the room, a team or group member must take the shot for them.

Execution of the indicated shot displayed from the GUEST SHOT playing card is conducted in association with the beer pong rules selected for game play. During game play, if the shooting player successfully executes the indicated shot, the shooting player or an alternate member of the successful shooting player's team or group selects another playing card from the card guided projectile and target game playing card deck 20. If the shooting player fails to execute the indicated shot, an opposing shooting player, which may be a member of an opposing team or group playing the game, selects a playing card.

Figure 4:
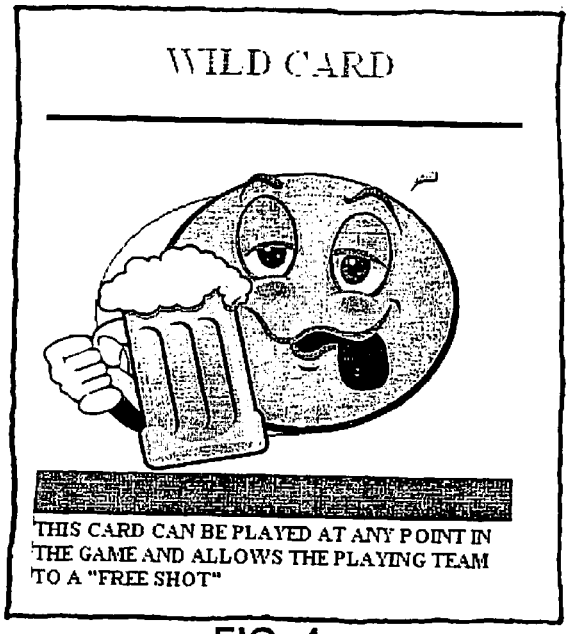
FIG. 4 is a plan view of one embodiment of a playing card for the game.

In one embodiment, a shooting player, may select a playing card, such as, for example, a WILD CARD playing card, as shown in FIG. 4. The WILD CARD playing card displays indicia to the shooting player, which includes the direction/guidance: THIS CARD CAN BE PLAYED AT ANY POINT IN THE GAME AND ALLOWS THE PLAYING TEAM TO A "FREE SHOT". As such, the shooting player will execute the turn or indicated shot as described on the WILD CARD playing card, as provided by the pictorial and graphic material of the WILD CARD playing card in connection with the above described textual instruction displayed from the playing card. The pictorial and graphic material of the WILD CARD playing card includes a facial representation of a ping pong ball holding a mug containing a beverage. It is contemplated that the WILD CARD playing card can be a joker card, where the player can save the card and call the card into play at a crucial time of the game so their team has an advantage. It is further contemplated that there is only one WILD CARD playing card in deck 20.

Execution of the indicated shot displayed from the WILD CARD playing card is conducted in association with the beer pong rules selected for game play. During game play, if the shooting player successfully executes the indicated shot, the shooting player or an alternate member of the successful shooting player's team or group selects another playing card from the card guided projectile and target game playing card deck 20. If the shooting player fails to execute the indicated shot, an opposing shooting player, which may be a member of an opposing team or group playing the game, selects a playing card. This game play continues until the game ends according to the preselected beer pong rules. It is contemplated that if all playing cards in the deck have been selected and the game has not ended, game play may be continued by reshuffling the playing cards and placing the reshuffled deck 20 face down on game board 10.

Deck 20 may include one or a plurality of each individual playing card. Deck 20 includes different playing cards for use during game play with the card guided projectile and target game, as described above.

In one embodiment, deck 20 includes an UNDERHAND ARC SHOT playing card (not shown). The UNDERHAND ARC SHOT playing card displays indicia to the shooting player, which includes the direction/guidance: PLAYER MUST SHOOT BALL UNDERHAND. BALL MUST NOT BOUNCE ON THE TABLE BEFORE GOING INTO ANY CUP. As such, the shooting player will execute the turn or indicated shot as described on the UNDERHAND ARC SHOT playing card, as provided by the pictorial and graphic material of the UNDERHAND ARC SHOT playing card in connection with the above described textual instruction displayed from the playing card. The pictorial and graphic material of the UNDERHAND ARC SHOT playing card includes a facial representation with a ping pong ball having an arc extending therefrom and hands exposing the palms.

In one embodiment, deck 20 includes an OPPOSITE HAND SHOT playing card (not shown). The OPPOSITE HAND SHOT playing card displays indicia to the shooting player, which includes the direction/guidance: PLAYER MUST SHOOT THE BALL WITH THEIR "NON-NATURAL" HAND. As such, the shooting player will execute the turn or indicated shot as described on the OPPOSITE HAND SHOT playing card, as provided by the pictorial and graphic material of the OPPOSITE HAND SHOT playing card in connection with the above described textual instruction displayed from the playing card. The pictorial and graphic material of the OPPOSITE HAND SHOT playing card includes a facial representation with a ping pong ball having and opposing hands with palms exposed. It is envisioned that the shooting player shoots the ball with their "non-natural" hand, for example, right-handed players shoot with their left hand and left-handed players shoot with their right hand.

In one embodiment, deck 20 includes an OPPOSITE HAND BOUNCE SHOT playing card (not shown). The OPPOSITE HAND BOUNCE SHOT playing card displays indicia to the shooting player, which includes the direction/guidance: PLAYER MUST PERFORM A "BOUNCE" SHOT WITH THEIR "NON-NATURAL" HAND. As such, the shooting player will execute the turn or indicated shot as described on the OPPOSITE HAND BOUNCE SHOT playing card, as provided by the pictorial and graphic material of the OPPOSITE HAND BOUNCE SHOT playing card in connection with the above described textual instruction displayed from the playing card. The pictorial and graphic material of the OPPOSITE HAND BOUNCE SHOT playing card includes a facial representation with a ping pong ball having an arc extending therefrom and opposing hands with palms exposed.

In one embodiment, deck 20 includes an OPPOSITE HAND ARC SHOT playing card (not shown). The OPPOSITE HAND ARC SHOT playing card displays indicia to the shooting player, which includes the direction/guidance: PLAYER MUST PERFORM AN "ARC" SHOT WITH THEIR "NON-NATURAL" HAND. As such, the shooting player will execute the turn or indicated shot as described on the OPPOSITE HAND ARC SHOT playing card, as provided by the pictorial and graphic material of the OPPOSITE HAND ARC SHOT playing card in connection with the above described textual instruction displayed from the playing card. The pictorial and graphic material of the OPPOSITE HAND ARC SHOT playing card includes a facial representation with a ping pong ball having an arc extending therefrom and opposing hands with palms exposed.

In one embodiment, deck 20 includes an ARC SHOT playing card (not shown). The ARC SHOT playing card displays indicia to the shooting player, which includes the direction/guidance: PLAYER MUST PERFORM AN "ARC" SHOT, BALL MAY NOT BOUNCE ON THE TABLE BEFORE GOING INTO ANY CUP. As such, the shooting player will execute the turn or indicated shot as described on the ARC SHOT playing card, as provided by the pictorial and graphic material of the ARC SHOT playing card in connection with the above described textual instruction displayed from the playing card. The pictorial and graphic material of the ARC SHOT playing card includes a facial representation with a ping pong ball having an arc extending therefrom. It is contemplate that the ball must not bounce on the table before going into any cup.

In one embodiment, deck 20 includes a DISTANCE SHOT playing card (not shown). The DISTANCE SHOT playing card displays indicia to the shooting player, which includes the direction/guidance: PLAYER MUST TAKE 2 STEPS BACK FROM THE TABLE BEFORE SHOOTING THE BALL. As such, the shooting player will execute the turn or indicated shot as described on the DISTANCE SHOT playing card, as provided by the pictorial and graphic material of the DISTANCE SHOT playing card in connection with the above described textual instruction displayed from the playing card. The pictorial and graphic material of the DISTANCE SHOT playing card includes a facial representation with a ping pong ball superimposed with an octagonal background. It is envisioned that the shooting player may be instructed to move various distances from the table.

In one embodiment, deck 20 includes a SEATED SHOT playing card (not shown). The SEATED SHOT playing card displays indicia to the shooting player, which includes the direction/guidance: PLAYER MUST BE SEATED WHEN SHOOTING THE BALL. As such, the shooting player will execute the turn or indicated shot as described on the SEATED SHOT playing card, as provided by the pictorial and graphic material of the SEATED SHOT playing card in connection with the above described textual instruction displayed from the playing card. The pictorial and graphic material of the SEATED SHOT playing card includes a facial representation with a ping pong ball disposed on a stool. It is contemplated that the shooting player must be seated rather than standing before shooting the ball. If the player stands before the ball releases from their hand it will not count.

In one embodiment, deck 20 includes a SEATED BOUNCE SHOT playing card (not shown). The SEATED BOUNCE SHOT playing card displays indicia to the shooting player, which includes the direction/guidance: PLAYER MUST PERFORM A "BOUNCE" SHOT WHILE SEATED RATHER THAN STANDING. As such, the shooting player will execute the turn or indicated shot as described on the SEATED BOUNCE SHOT playing card, as provided by the pictorial and graphic material of the SEATED BOUNCE SHOT playing card in connection with the above described textual instruction displayed from the playing card. The pictorial and graphic material of the SEATED BOUNCE SHOT playing card includes a facial representation with a ping pong ball disposed on a stool and having an arc extending therefrom.

In one embodiment, deck 20 includes a BLINDFOLD SHOT playing card (not shown). The BLINDFOOD SHOT playing card displays indicia to the shooting player, which includes the direction/guidance: PLAYER MUST CLOSE THEIR EYES OR WEAR A BLINDFOOD WHEN SHOOTING. As such, the shooting player will execute the turn or indicated shot as described on the BLINDFOLD SHOT playing card, as provided by the pictorial and graphic material of the BLINDFOLD SHOT playing card in connection with the above described textual instruction displayed from the playing card. The pictorial and graphic material of the BLINDFOLD SHOT playing card includes a facial representation with a ping pong ball blindfolded.

In one embodiment, deck 20 includes a HOUSE SHOT playing card (not shown). The HOUSE SHOT playing card displays indicia to the shooting player, which includes the direction/guidance: THIS CARD IS WHERE THE "HOUSE" WRITES IN THEIR OWN RULE. As such, the shooting player will execute the turn or indicated shot as described on the HOUSE SHOT playing card, as provided by the pictorial and graphic material of the HOUSE SHOT playing card in connection with the above described textual instruction displayed from the playing card. The pictorial and graphic material of the HOUSE SHOT playing card includes a facial representation with a ping pong ball superimposed with a rectangular background.

In one embodiment, deck 20 includes a PLAYER'S CHOICE SHOT playing card (not shown). The PLAYER'S CHOICE SHOT playing card displays indicia to the shooting player, which includes the direction/guidance: PLAYER MUST SHOOT THE BALL IN ANY MANNER THEY CHOOSE. As such, the shooting player will execute the turn or indicated shot as described on the PLAYER'S CHOICE SHOT playing card, as provided by the pictorial and graphic material of the PLAYER'S CHOICE SHOT playing card in connection with the above described textual instruction displayed from the playing card. The pictorial and graphic material of the PLAYER'S CHOICE SHOT playing card includes a facial representation with a ping pong ball superimposed with a star background.

In one embodiment, deck 20 includes a 2 FOR 1 SHOT playing card (not shown). The 2 FOR 1 SHOT playing card displays indicia to the shooting player, which includes the direction/guidance: IF PLAYER MAKES SHOT, REMOVE A SECOND CUP FROM YOUR OPPONENT'S SIDE OF THE TABLE OR ADD A CUP TO YOUR SIDE. As such, the shooting player will execute the turn or indicated shot as described on the 2 FOR 1 SHOT playing card, as provided by the pictorial and graphic material of the 2 FOR 1 SHOT playing card in connection with the above described textual instruction displayed from the playing card. The pictorial and graphic material of the 2 FOR 1 SHOT playing card includes a facial representation with a ping pong ball centered within a triangle of upward facing cups of a beverage. It is envisioned that if the player makes the shot, they have the option of removing an additional cup from their opponent's side of the table or adding a cup to their side of the table.

In one embodiment, deck 20 includes a BUZZ SHOT playing card (not shown). The BUZZ SHOT playing card displays indicia to the shooting player, which includes the direction/guidance: SAVE THIS "FREE SHOT" CARD THAT CAN BE PLAYED AT ANY POINT DURING THE GAME. SELECT ANOTHER CARD. As such, the shooting player will execute the turn or indicated shot as described on the BUZZ SHOT playing card, as provided by the pictorial and graphic material of the BUZZ SHOT playing card in connection with the above described textual instruction displayed from the playing card. The pictorial and graphic material of the BUZZ SHOT playing card includes a facial representation with a ping pong ball disposed between the terms FREE and SHOT.

In one embodiment, deck 20 includes a DROP SHOT playing card (not shown). The DROP SHOT playing card displays indicia to the shooting player, which includes the direction/guidance: PLAYER LOSES A TURN. As such, the shooting player will execute the turn or indicated shot as described on the DROP SHOT playing card, as provided by the pictorial and graphic material of the DROP SHOT playing card in connection with the above described textual instruction displayed from the playing card. The pictorial and graphic material of the DROP SHOT playing card includes a facial representation with a ping pong ball disposed between open ends of opposing cups.

In one embodiment, deck 20 includes a SEATED ARC SHOT playing card (not shown). The SEATED ARC SHOT playing card displays indicia to the shooting player, which includes the direction/guidance: PLAYER MUST PERFORM AN "ARC" SHOT WHILE SEATED RATHER THAN STANDING. As such, the shooting player will execute the turn or indicated shot as described on the SEATED ARC SHOT playing card, as provided by the pictorial and graphic material of the SEATED ARC SHOT playing card in connection with the above described textual instruction displayed from the playing card. The pictorial and graphic material of the SEATED ARC SHOT playing card includes a facial representation with a ping pong ball disposed on a stool and having an arc extending therefrom.

In one embodiment, deck 20 includes an UNDERHAND BOUNCE SHOT playing card (not shown). The UNDERHAND BOUNCE SHOT playing card displays indicia to the shooting player, which includes the direction/guidance: PLAYER MUST SHOOT BALL UNDERHAND. BALL MUST BOUNCE ON THE TABLE BEFORE GOING INTO ANY CUP. As such, the shooting player will execute the turn or indicated shot as described on the UNDERHAND BOUNCE SHOT playing card, as provided by the pictorial and graphic material of the UNDERHAND BOUNCE SHOT playing card in connection with the above described textual instruction displayed from the playing card. The pictorial and graphic material of the UNDERHAND BOUNCE SHOT playing card includes a facial representation with a ping pong ball having an arc extending therefrom and hands with palms facing inwardly.

The following Table provides exemplary embodiments of playing cards of the card guided projectile and target game of the present disclosure and instructions.

TABLE

| Card Type | Instructions |
|---|---|
| Bounce Shot | The player must perform a "bounce" shot, the ball must bounce on the table before going into any cup. |
| Arc Shot | The player must perform an "arc" shot, the ball may not bounce on the table before going into any cup. |
| Seated Shot | The player must be seated when shooting the ball. |
| Seated Bounce Shot | The player must perform a "bounce shot" while seated rather than standing. |
| Seated Arc Shot | The player must perform an "arc shot" while seated rather than standing |
| Underhand Bounce Shot | The player must shoot the ball underhand. The ball must bounce on the table before going into any cup. |
| Underhand Arc Shot | The player must shoot the ball underhand. The ball must not bounce on the table before going into any cup. |
| Opposite Hand Shot | The player must shoot the ball with their "non-natural" hand. |
| Opposite Hand Bounce Shot | The player must perform a "bounce shot" with their "non-natural" hand. |
| Opposite Hand Arc Shot | The player must perform an "arc shot" with their "non-natural"hand. |
| Distance Shot | The player must take two steps back from the table before shooting the ball. |
| Blindfold Shot | The player must close their eyes or wear a blindfold when shooting. |
| House Shot | The "House" writes in their own rule on this card. |
| Player's Choice Shot | The player may shoot the ball in any manner they choose. |

TABLE-continued

| Card Type | Instructions |
|---|---|
| 2 For 1 Shot | If player makes shot, remove a second cup from your opponent's side of the table or add a cup to your side. |
| Buzz Shot | This "free shot" is saved and may be played at any point during the game. Another card is selected. |
| Guest Shot | Player must invite anyone other than active players to shoot in their place. |
| Drop Shot | Player loses a turn. |
| Game Rules | Instructions for game play. |

During game play, if all cards are played before the game is over, they are to be shuffled again and deck 20 replaced to start again. Deck 20 of playing cards may include advertisement cards to be included on a website address, offers of personalized "logo" cards and supplies such as ping pong balls.

In one embodiment, the deck of playing cards can be individualized decks, large card decks, two deck shrink package with 3 ping pong balls included. In another embodiment, the game may include a cube of 5 decks or more.

Referring again to FIGS. 1-4 and the playing cards of the present disclosure, in one embodiment, card-guided projectile and target game forms part of a kit including one or more decks 20 of playing cards, as described herein, ping pong ball(s), a game board 10, and instructions for employing the kit with a beverage drinking game, such as those described herein.

The card-guided projectile and target game of the present disclosure may be incorporated into a video game or other media, as is contemplated herein.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A card-guided projectile and target game, the game comprising:

a game surface having first and second opposite ends and extending lengthwise therebetween, said surface including indicia for delineating regions of the surface;

at least one projectile;

at least one cup separate and movable from the game surface; and at least on playing card including a face that displays indicia for in-game card guided play of a beverage drinking game, the indicia including at least one of printed textual, graphic or pictorial directions for at least one player to manipulate and shoot the at least one projectile into the at least one cup, the directions including at least one of a type of a shot and a form of the shot.

2. The card-guided projectile and target game of claim 1, wherein the game surface is flexible.

3. The card-guided projectile and target game of claim 1, wherein the game surface is flexible.

4. The card-guided projectile and target game of claim 1, wherein the indicia of the at least one playing card includes graphic material displaying a facial representation with a ping pong ball.

5. The card-guided projectile and target game of claim 4, wherein the indicia of the at least one playing card further includes a graphical representation of an instructed action for the ping pong ball.

6. The card-guided projectile and target game of claim 1, wherein the at least one playing card includes a plurality of playing cards, one of the plurality of playing cards comprising directions that include the at least one player bouncing the at least one projectile onto the game surface and into the at least one cup.

7. The card-guided projectile and target game of claim 1, wherein the at least one playing card includes a plurality of playing cards, one of the plurality of playing cards comprising directions that include the at least one player bouncing the at least one projectile onto the game surface and into the at least one cup without an arcuate trajectory.

8. The card-guided projectile and target game of claim 1, wherein the at least one playing card includes a plurality of playing cards, one of the plurality of playing cards comprising directions that include the at least one player being seated and shooting the at least one projectile into the at least one cup.

* * * * *